US008385576B2

(12) United States Patent
Hedrick et al.

(10) Patent No.: US 8,385,576 B2
(45) Date of Patent: Feb. 26, 2013

(54) BONE CONDUCTION COMMUNICATIONS HEADSET WITH HEARING PROTECTION

(75) Inventors: Randall Hedrick, Topeka, KS (US); Darrell W. Goodnow, Silver Lake, KS (US); David J. Bondarenko, Topeka, KS (US)

(73) Assignee: Atlantic Signal, LLC, Silver Lake, KS (US)

( * ) Notice: Subject to any disclaimer, the term of this patent is extended or adjusted under 35 U.S.C. 154(b) by 148 days.

(21) Appl. No.: 12/833,067

(22) Filed: Jul. 9, 2010

(65) Prior Publication Data

US 2011/0007927 A1 Jan. 13, 2011

Related U.S. Application Data

(60) Provisional application No. 61/224,740, filed on Jul. 10, 2009.

(51) Int. Cl.
*H04R 25/00* (2006.01)

(52) U.S. Cl. ..... 381/376; 381/151; 381/380

(58) Field of Classification Search ..... 381/151, 381/376, 379, 380, 326, 328
See application file for complete search history.

(56) References Cited

U.S. PATENT DOCUMENTS

| | | | |
|---|---|---|---|
| D424,568 | S | 5/2000 | Gerdom |
| D425,511 | S | 5/2000 | Gerdom |
| D428,875 | S | 8/2000 | Gerdom |
| D444,142 | S | 6/2001 | Gerdom |
| D454,554 | S | 3/2002 | Gerdom |
| 6,374,126 | B1 | 4/2002 | MacDonald, Jr. et al. |
| D460,752 | S | 7/2002 | Gerdom |
| 6,456,721 | B1 | 9/2002 | Fukuda |
| D550,656 | S | 9/2007 | Gerdom et al. |
| 2006/0227982 | A1 | 10/2006 | Miranda |
| 2009/0060231 | A1 | 3/2009 | Buroojy |
| 2009/0092269 | A1 | 4/2009 | Nielsen et al. |

FOREIGN PATENT DOCUMENTS

| | | | |
|---|---|---|---|
| EP | 0806099 | B1 | 8/2000 |
| WO | WO 2007/107985 | A2 | 9/2007 |
| WO | WO 2007107985 | A2 | 9/2007 |
| WO | WO 2007133055 | A1 | 11/2007 |

OTHER PUBLICATIONS

International Search Report and the Written Opinion of the International Searching Authority in International Application No. PCT/US/2010/041517 which claims priority from U.S. Appl. No. 12/833,067.

*Primary Examiner* — Jeffrey Donels
(74) *Attorney, Agent, or Firm* — Erickson, Kernell, Derusseau & Kleypas, LLC

(57) ABSTRACT

A communications headset includes bone vibrating transducers supported over the temporal bones of a wearer in front of each ear and an earpiece. The earpieces, when not in use, are selectively securable in a holster formed on each transducer housing. Radio signals received by a wearer or vehicular mounted radio are processed by and distributed through a communications interface to both the transducers and the earpiece speakers. Ambient or external noises picked up by one or more microphones on each earpiece are processed to reduce ambient noises above a certain level.

18 Claims, 4 Drawing Sheets

Fig.4.
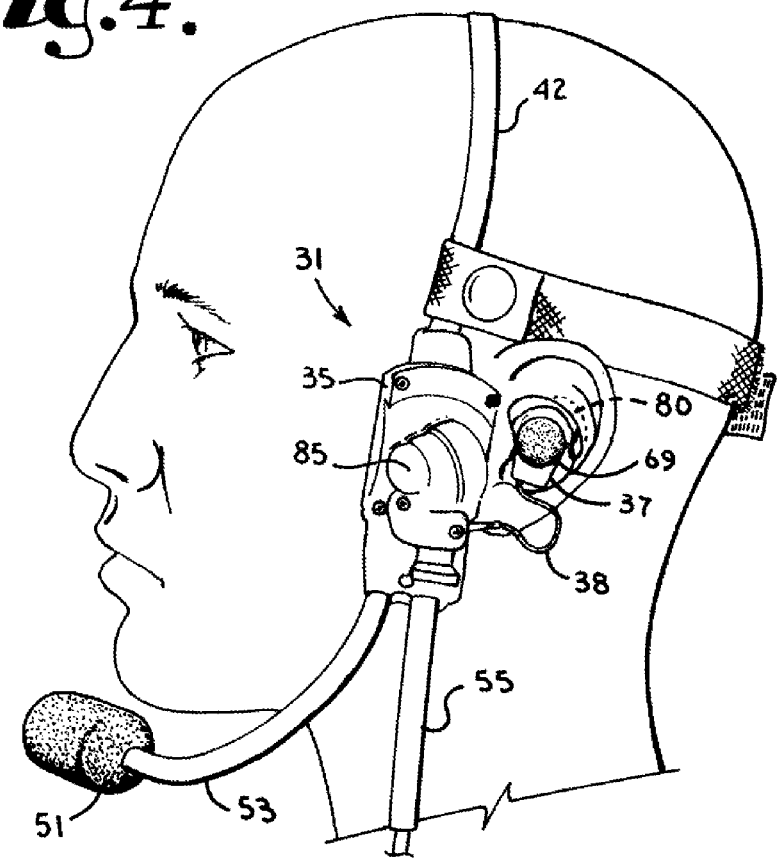
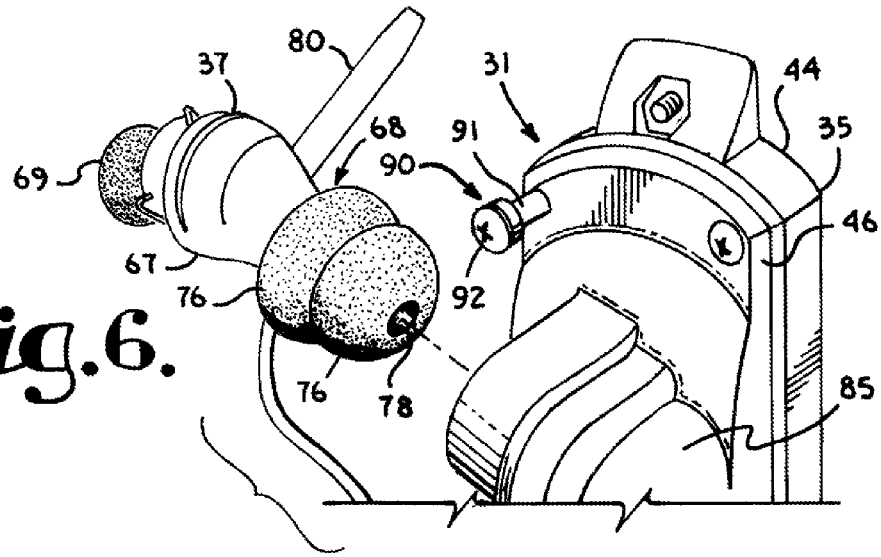
Fig.6.

BONE CONDUCTION COMMUNICATIONS HEADSET WITH HEARING PROTECTION

CROSS REFERENCE TO RELATED APPLICATIONS

This application claims the benefit of Provisional Application Ser. No. 61/224,740, filed Jul. 10, 2009

BACKGROUND OF THE INVENTION

1. Field of the Invention

The present invention relates to communications headsets.

2. Description of the Related Art

Conventional communications headsets include acoustic speakers for directing sound waves generated by a radio receiver or other circuitry into a wearer's ear canal and the auditory mechanism responsible for hearing. In the headset industry, it is also known to use bone vibrating transducers mounted in housings incorporated into a headset to transmit sound waves generated by a radio receiver through the temporal bones or other cranial bones of a wearer directly to the inner ear cochlea, allowing sounds to bypass the eardrum. See for example, U.S. Design Pat. No. D550,656. Headsets incorporating bone vibrating transducers are known to be particularly useful in applications in which the wearer wants to leave the auditory canal of the ear unoccluded to hear sounds in the ambient environment. Bone vibrating transducer headsets are also advantageous in that they allow the wearer to engage and disengage various forms of hearing protection while having no negative impact on the wearer's ability to hear radio transmissions.

There remains a need for improved communications headsets for military and law enforcement tactical applications.

BRIEF DESCRIPTION OF THE DRAWINGS

FIG. 4 is a fragmentary side view of an alternative embodiment of the communications headset shown secured to the head of a wearer with an earpiece positioned in the wearer's ear.

FIG. 6 is an exploded, enlarged and fragmentary, right side perspective view of the housing of the communications headset similar to FIG. 5 showing the earpiece separated from the holster.

DETAILED DESCRIPTION OF THE PREFERRED EMBODIMENTS

Figure 1:
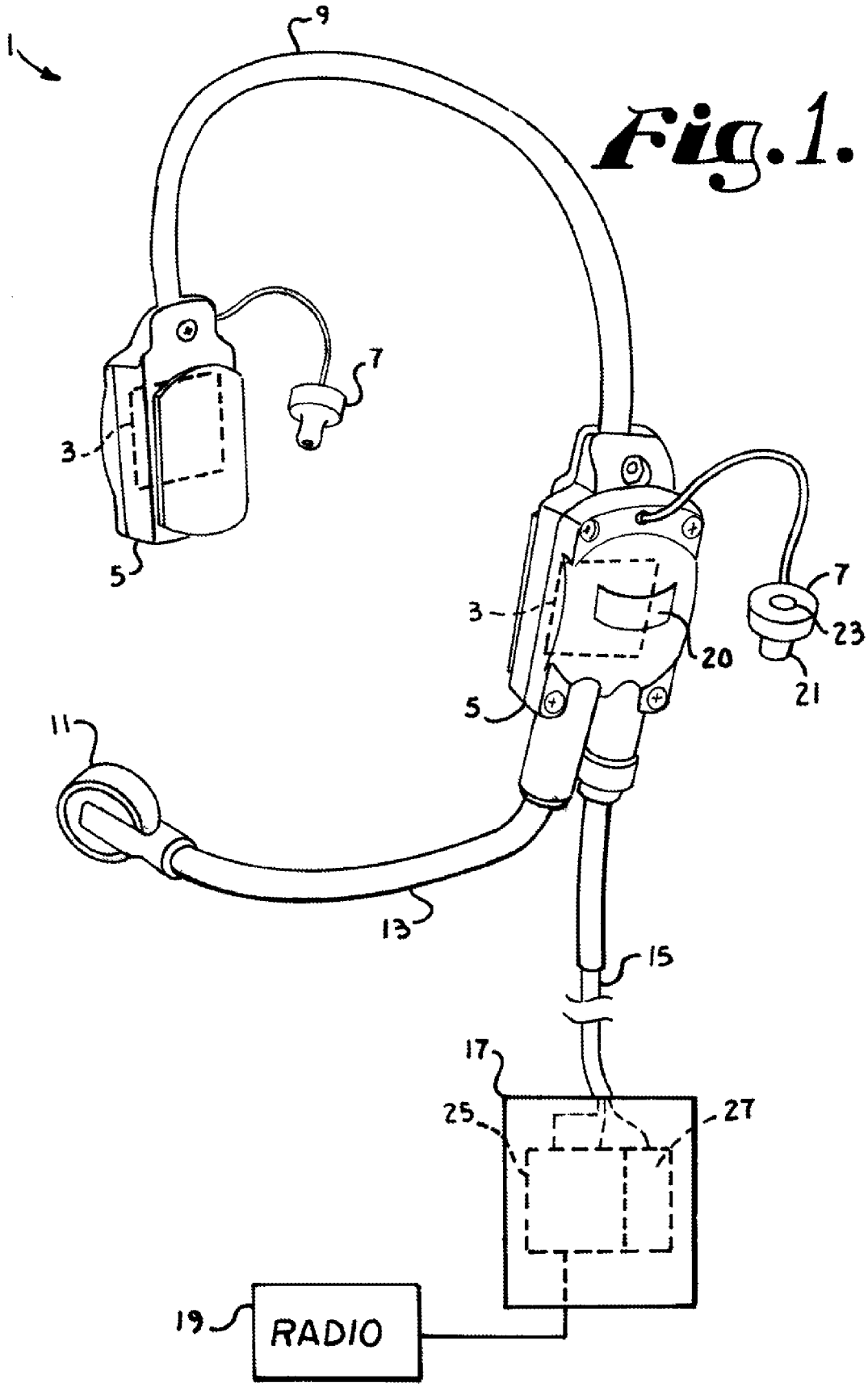
FIG. 1 is a perspective and partially schematic view of a communications headset in combination with a radio and a communications interface.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
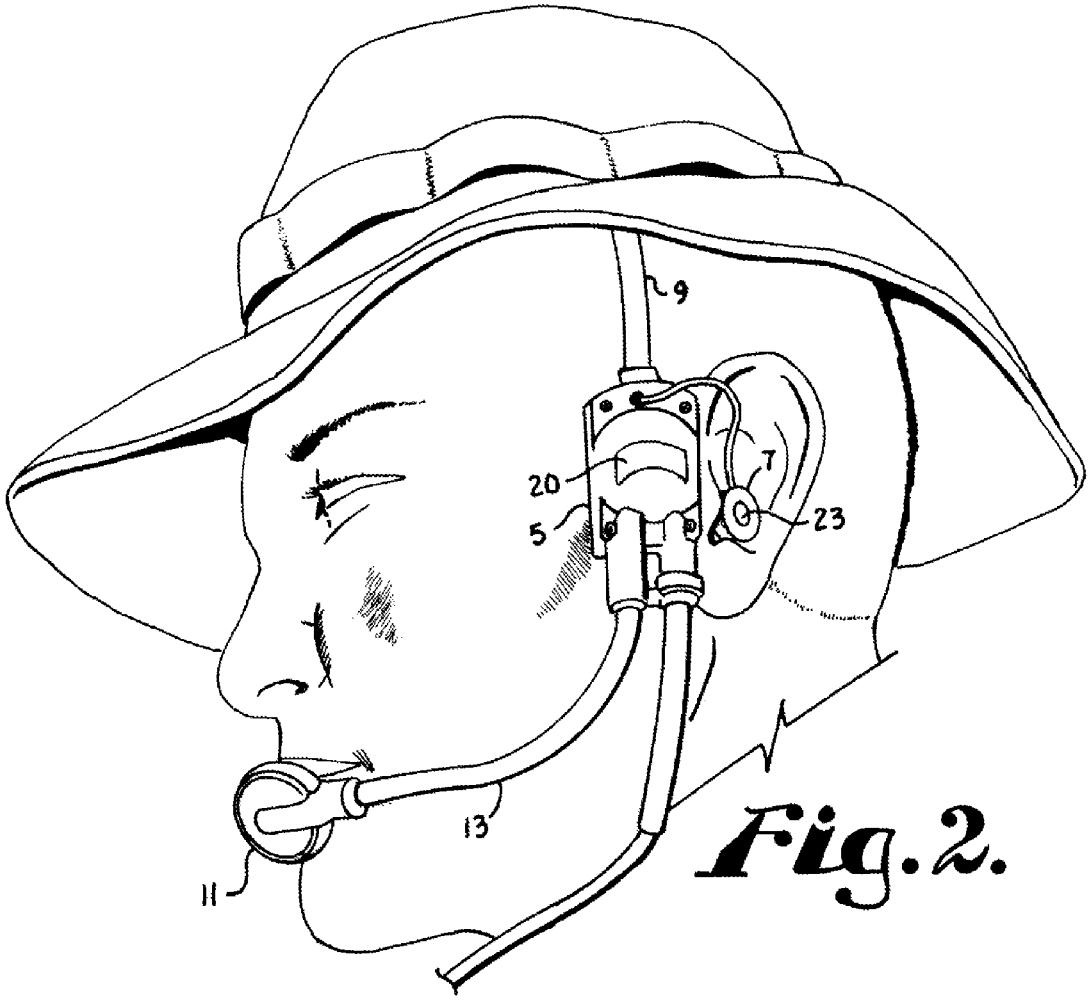
FIG. 2 is a perspective, fragmentary and partially schematic view of a communications headset on a wearer's head showing an earpiece for the communications headset positioned in the wearer's ear.
Figure 3:
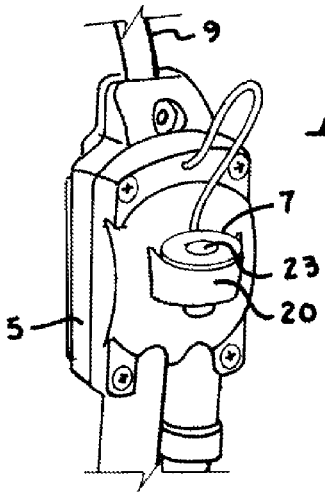
FIG. 3 is a perspective and fragmentary view of the communications headset showing the earpiece holstered in a holster on the body of the communications headset.
Figure 5:
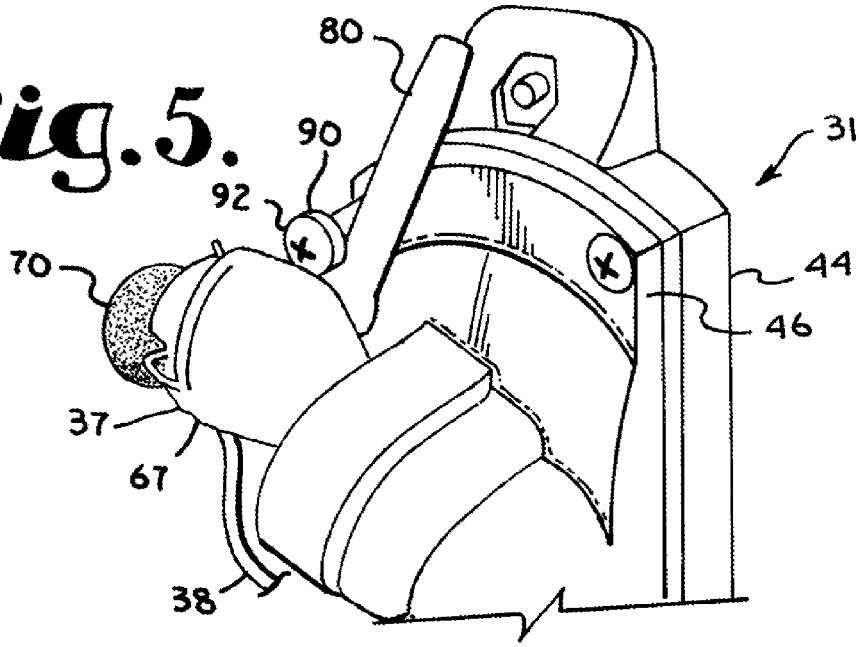
FIG. 5 is an enlarged and fragmentary, right side perspective view of a housing of the communications headset as shown in FIG. 4 showing the earpiece secured in a holster thereon.

Referring to the drawings in more detail, the reference number 1 generally designates a communications headset incorporating a pair of bone vibrating transducers 3 mounted in housings 5 for distributing received radio signals as sound waves through a wearer's temporal bones or other cranial bones to the inner ear or auditory system in simultaneous combination with a pair of earpieces 7 for distributing received radio signals as sound waves through a wearer's auditory canal to the auditory system. It is foreseen that the earpieces 7 could also be ear plugs and not function to transmit sound through the wearer's auditory canal. As used herein, earpiece is intended to include an ear plug that does not function to transmit sound through the wearer's auditory canal. In the embodiment shown in FIGS. 1-3 in which the earpieces 7 do transmit sound waves, the earpieces are connected to the respective transducer housing 5 by a wire or conductor 8. Sound waves are transmitted through the wires 8 which also function to tether the earpieces to the respective transducer housing 5.

Although not limited to a single configuration, the transducer housings 5 may be mounted on a frame, strap or other head gear 9 for supporting the housings 5 against the temporal bones of a wearer in front of the ears. A microphone 11 mounted on a boom arm 13 is connected to one of the transducer housings 5. A communications link or cable 15 connects the transducer housing 5 with the attached microphone 11 to a communications interface 17 which may be mounted on the body of a wearer and changed between transmit and receive modes with any of a variety of switches. The interface 17 is then wired or otherwise linked to a radio 19 which may be worn in various locations on the user's body or mounted within various types of vehicles.

Each transducer 3 is wired to the communications interface 17 as is each earpiece 7. The earpieces 7 are wired through the associated transducer housing 5. A holster-like storage compartment 20 is mounted on each transducer housing 5 such that the associated earpiece 3 may be stored in the holster 20 when not in use. The earpieces may be disconnected and replaced by the user. Removal of the earpieces will not affect the headset's ability to receive or transmit radio communications through the bone vibrating transducers, the boom microphone and their associated circuitry.

The earpieces, when properly inserted in the ear canals, will provide the wearer with a certain level of passive hearing protection. Each earpiece 7 includes a speaker portion 21 and one or more microphones 23. The speaker portion 21 is directed inwardly toward the wearer's ear canal and serves two purposes: a) to deliver incoming communications received from the radio or any other external audio source, and b) to deliver sounds from the wearer's ambient environment to the ear canal. Ambient or environmental sounds are detected by the microphone(s) 23 that face outwardly, and are then electronically processed and distributed to the speakers.

The interface 17 includes a housing 24 with an internally mounted transducer circuit board 25 for processing signals from the radio 19 to the transducers 3 and from the headset microphone 11 back to the radio 19. Additionally, the interface 17 includes a second internally mounted earpiece circuit board 27 for processing incoming radio signals and distributing them to the earpiece speaker portions 21 through the wires 8, and for processing sounds detected by the earpiece microphone(s) 23 and distributing those processed sounds back to the earpiece speaker portions 21. Processing may include attenuating or reducing loud external sounds to protect the wearer's hearing. This processing may include the use of ANR or Active Noise Reduction circuitry. For example, the earpieces 7 may be used to reduce the noise level of gunshots detected by the microphone(s) 23 while simultaneously allowing the wearer to hear radio communications through the speaker portions 21. Processing may also include amplifying the wearer's ambient environment while simultaneously providing the wearer with adequate situational and directional awareness. The transducer circuit board 25 is linked to the earpiece circuit board 27 to deliver radio signals or other external audio signals from the transducer circuit board 25 to the earpiece circuit board 27.

Referring to FIGS. 4-7 there is shown an alternative embodiment of a bone vibrating transducer headset 31 incorporating bone vibrating transducers 33 mounted in housings 35 for distributing received radio signals as sound waves through a wearer's temporal bones or other cranial bones to the inner ear or auditory system in simultaneous combination with a pair of earpieces 37 for distributing received radio signals as sound waves through a wearer's auditory canal to the auditory system. Only one transducer housing 35 and earpiece 37 is shown in FIGS. 4-7. A second transducer housing with earpiece 37, not shown, is mounted on the opposite side of the wearer's head.

Figure 7:
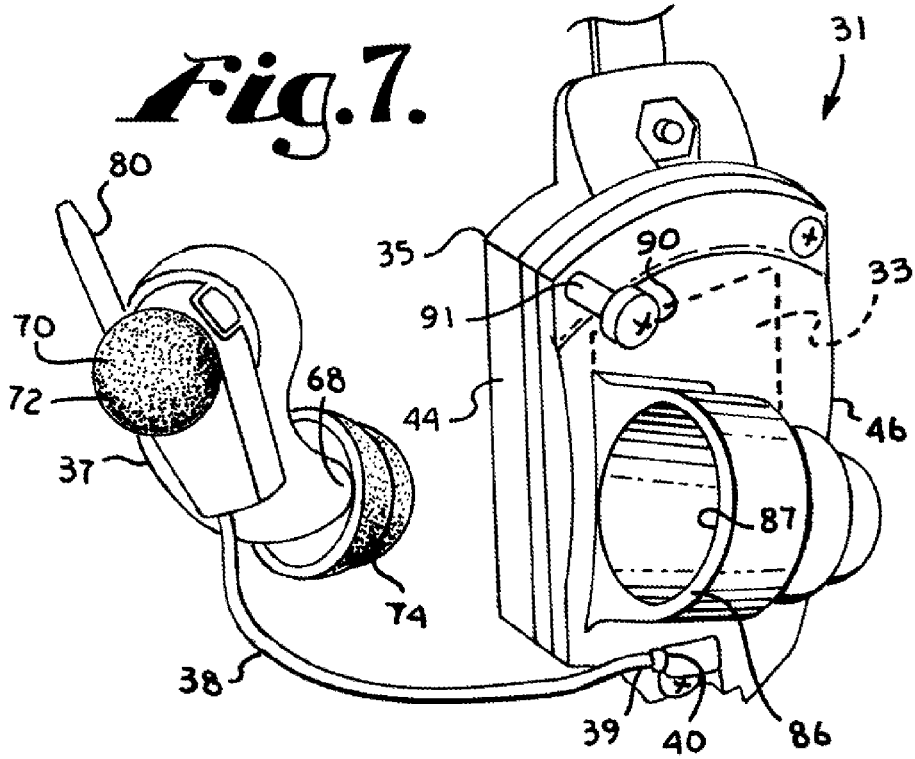
FIG. 7 is an enlarged and fragmentary, left side perspective view of the communications headset housing showing the earpiece separated therefrom.

In some applications, a single transducer 33 and earpiece is used and worn on one side of the head. The transducer 33 and housing 35 may be referred to as a transducer head piece, transducer assembly or simply as a transducer. As best seen in FIG. 7, each earpiece 37 is connected to the respective transducer housing 35 by a wire or conductor 38 which has a plug end 39 which is removably connectable to a socket 40 formed in the housing 35. Sound waves are transmitted through the wire 38 which also functions to tether the earpiece 37 to the respective transducer housing 5. As with the first embodiment described above, it is foreseen that the earpieces 37 could also be ear plugs and not function to transmit sound through the wearer's auditory canal. The earpiece 37 shown in FIGS. 4-7 is a Serenity DPC brand earpiece supplied by Phonak Communications, AG.

The transducer housings 35 may be mounted on a frame, strap or other head gear 42 for supporting the housings 35 against the temporal bones of a wearer in front of the ears. The transducer housings 35 are generally formed from a base 44 and a cover plate 46 that is bolted onto the base 44. The base 44 and cover plate 46 are preferably molded with thirty three percent glass filled nylon comprising an appropriate material of construction. The transducer 33 is positioned within a cavity formed in the base 44 and covered by the cover plate 46. A sealing layer or gasket (not shown) may be formed between the base 44 and the cover plate 46. A layer of foam padding (not shown) is preferably adhered to the surface of the base 44 to be positioned against a wearer's face for comfort.

As with the first embodiment, a microphone 51 mounted on a boom arm 53 is connected to one of the transducer housings 35. A communications link or cable 55 connects the transducer housing 35 with the attached microphone 51 to a communications interface (not shown in FIGS. 4-7) which may be mounted on the body of a wearer and changed between transmit and receive modes with any of a variety of switches. The interface may be of the type shown in FIG. 1 as communications interface 17 which is wired or otherwise linked to a radio 19 which may be worn in various locations on the user's body or mounted within various types of vehicles. Each transducer 33 is wired to the communications interface 17 as is each earpiece 37. As noted above, a plug end 39 of the wire 38 for each earpiece 37 may be inserted in a socket 40 formed in the housing 35 which is in turn electrically connected to the communications interface 17. The earpieces 37 may be disconnected and replaced by the user. Removal of the earpieces 37 will not affect the headset's ability to receive or transmit radio communications through the bone vibrating transducers 33, the boom microphone 51 and their associated circuitry.

Each earpiece 37, includes an earpiece body 67 with a speaker portion 68 and one or more microphones 70 connected thereto or mounted thereon. The speaker portion 68 is directed inwardly toward the wearer's ear canal and serves two purposes: a) to deliver incoming communications received from the radio or any other external audio source, and b) to deliver sounds from the wearer's ambient environment to the ear canal. Ambient or environmental sounds are detected by the microphone 70 that face outwardly, and are then electronically processed and distributed to the speakers.

A foam wind cover 72 is secured around the microphone 70 to reduce noise from wind. A resilient tip or ear bud 74 is secured around the speaker portion 68 to more securely hold the earpiece 37 in a wearer's ear, particularly while the wearer is moving around in field conditions. In the embodiment shown the resilient tip 74 is formed from a flexible silicone material with two hemispherical flanges or barbs 76 projecting outward from a central bore 78 through which sound is transmitted to the auditory canal of the wearer.

A flexible concha bow 80 is mounted on and projects outward from the earpiece body 67 between the microphone 70 and the speaker portion 68. The concha bow 80 generally extends transverse to the speaker portion 68. The concha bow 80 is formed from a flexible plastic and is generally tubular in shape and sized for insertion into the concha which is the largest and deepest cavity in the wearer's ear. Referring to FIG. 4, the concha bow 80 (shown in phantom lines) engages the flap of skin extending adjacent the concha of the wearer's ear to further secure the earpiece 67 in place therein.

An earpiece holster 85 is mounted on or formed on the cover plate 46 of each transducer housing 35 such that the associated earpiece 37 may be stored in or secured to the holster 85 when not in use. The holster 85 is preferably integrally molded into the cover plate 46 forming a holster sheath or wall 86 which surrounds and defines a holster cavity 87. The holster cavity preferably opens rearwardly and slightly upward relative to the housing 35 as positioned on the head of a wearer. An axis through the cavity and out the opening to the cavity generally extends upward at an angle of roughly thirty degrees relative to horizontal when the headset 31 is worn. The holster wall 86 and the holster cavity 87 taper inward from the rear opening to the cavity toward the front of the transducer housing 35. In the embodiment shown, the holster wall 86 incorporates a stepped configuration with each step of reduced diameter.

The holster cavity 87 is sized and shaped to frictionally or snugly receive the resilient tip 74 of the associated earpiece 37 to removably secure or hold the earpiece 37 in the holster 85. A concha bow stop 90 projecting outward from the housing cover plate 46 cooperates with the concha bow 46 to resist removal of the earpiece 37 from the holster 85. In the embodiment shown, the concha bow stop 90 projects outward from the upper left corner of the housing cover plate 46. The stop 90 generally comprises a screw hub or spacer 91 through which a screw 92 used to secure the cover plate 46 to the base 44 is threaded. The stop 90 is spaced slightly behind an upper, rear edge of the holster wall 86.

When the resilient tip 74 of the earpiece speaker 68 is secured in the holster cavity 87, the concha bow 80 generally extends just behind a rear edge of the holster wall 86. The earpiece 37 may be rotated slightly to rotate the concha bow 80 toward the head of the wearer to advance the concha bow 80 in front of or on the forward side the concha bow stop 90 relative to the head of the wearer. Abutment of the concha bow 80 against the concha bow stop 90 prevents the earpiece 37 from moving or sliding rearwards and out of the holster 85. The earpiece 37 is removed from the holster 85 by first rotating the earpiece slightly to pivot the concha bow out of overlapping relationship with the concha bow stop 90 and then pulling the earpiece 37 rearward pulling resilient tip 74 out of the holster cavity 87.

The communications interface used in association with headset 31 may be of similar construction as interface 17 of the headset embodiment shown in FIG. 1 which includes a housing 24 with an internally mounted transducer circuit board 25 for processing signals from a radio such as radio 19 to the transducers 33 and from the headset microphone 51 back to the radio 19. The interface 17 also includes a second internally mounted circuit board or earpiece circuit board 27 for processing incoming radio signals and distributing them to the earpiece speaker portions 68 through the wires 38, and for processing sounds detected by the earpiece microphone or microphones 70 and distributing those processed sounds back to the earpiece speaker portions 68. Processing may include attenuating or reducing loud external sounds to protect the wearer's hearing. This processing may include the use of ANR or Active Noise Reduction circuitry as discussed previously. Wiring, not shown, extending through the headgear 42, connects the transducer 33 and earpiece 37 to which the microphone 51 and interface cable 95 are attached, to the opposite transducer 33 and earpiece 37.

It is to be understood that while certain forms of the present invention have been illustrated and described herein, it is not to be limited to the specific forms or arrangement of parts described and shown. For example, it is foreseen that the communications headset could utilize a single bone vibrating transducer mounted on one side of the wearer's head and correspondingly a single earpiece.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A communications headset including:

a) a bone vibrating transducer secured within a housing;

b) a headgear connected to said housing for supporting said housing against a face of a wearer proximate an ear;

c) an earpiece tethered to said housing for said bone vibrating transducer of said communications headset, said earpiece including a resilient tip for insertion in a wearer's auditory canal; and d) a holster on an outer surface of said housing to which said earpiece is removably securable; said holster having a holster cavity sized to receive and frictionally engage said resilient tip of said earpiece.

2. The communications headset as in claim 1 wherein said holster is integrally formed with said housing for said bone vibrating transducer.

3. The communications headset as in claim 2 wherein said transducer housing is supported in front of a wearer's ear and said holster includes a holster wall surrounding the holster cavity which opens rearwardly and upwardly relative to the head of the wearer.

4. The communications headset as in claim 3 wherein a stop projects from said housing rearward of said holster for selectively engaging said earpiece when said earpiece is positioned in said holster to resist withdrawal of said earpiece from said holster.

5. The communications headset as in claim 1 wherein said earpiece includes a concha bow projecting therefrom for insertion in the concha of the ear of a wearer and a concha bow stop is formed on and projects from said housing for selectively engaging said concha bow to resist withdrawal of said earpiece from said holster.

6. The communications headset as in claim 1 wherein said earpiece is removably tethered to said housing by a conductor.

7. A communications headset including:

a) a bone vibrating transducer secured within a housing;

b) a headgear connected to said housing for supporting said housing against a face of a wearer in front of an ear;

c) an earpiece having an earpiece body with a speaker portion having a resilient tip extending therefrom sized for insertion in the auditory canal of a wearer and at least one microphone incorporated into said earpiece, said earpiece tethered to said housing; and d) a holster integrally formed as part of said housing on an outer surface thereof; said holster including a holster wall surrounding a holster cavity which opens rearwardly and upwardly relative to the head of the wearer said holster cavity sized to frictionally engage said resilient tip of said earpiece.

8. The communications headset as in claim 7 a stop projects from said housing rearward of said holster for selectively engaging said earpiece to resist withdrawal of said earpiece from said holster.

9. The communications headset as in claim 7 wherein said earpiece includes a concha bow projecting therefrom for insertion in the concha of the ear of a wearer and a concha bow stop is formed on and projects from an upper rear corner of said housing for selectively engaging said concha bow when said earpiece is positioned in said holster to resist withdrawal of said earpiece from said holster.

10. The communications headset as in claim 7 wherein said earpiece is removably tethered to said housing by a conductor.

11. The communications headset as in claim 7 wherein said earpiece is removably tethered to said housing by a conductor having a plug end which is removably secureable in a socket formed in said housing.

12. A communications headset including:

a) a bone vibrating transducer secured within a housing;

b) a headgear connected to said housing for supporting said housing against a face of a wearer in front of an ear;

c) an earpiece having an earpiece body with a speaker portion extending therefrom sized for insertion in the auditory canal of a wearer and at least one microphone incorporated into said earpiece, said earpiece having a resilient tip secured to said speaker portion; and said earpiece being removably tethered to said communications headset by a conductor having a plug end removably securable within a socket formed in said housing; and d) a holster integrally formed as part of said housing on an outer surface thereof; said holster including a holster wall surrounding a holster cavity which opens rearwardly and upwardly relative to the head of the wearer; said holster cavity is sized to receive the resilient tip of said earpiece to result in frictional engagement of said resilient tip with said holster.

13. The communications headset as in claim 12 wherein a stop projects from said housing rearward of said holster for selectively engaging said earpiece to resist withdrawal of said earpiece from said holster.

14. The communications headset as in claim 12 wherein said earpiece includes a concha bow projecting therefrom for insertion in the concha of the ear of a wearer and a concha bow stop is formed on and projects from an upper rear corner of said housing for selectively engaging said concha bow when said earpiece is positioned in said holster to resist withdrawal of said earpiece from said holster.

15. A communications headset including:

a) a bone vibrating transducer secured within a housing;

b) a headgear connected to said housing for supporting said housing against a face of a wearer proximate an ear;

c) an earpiece tethered to said housing for said bone vibrating transducer; and d) a holster on said housing to which said earpiece is removably securable.

16. The communications headset as in claim 15 wherein said holster is integrally formed with said housing for said bone vibrating transducer.

17. The communications headset as in claim 16 wherein said transducer housing is supported in front of a wearer's ear and said holster includes a holster wall surrounding a holster cavity which opens rearwardly and upwardly relative to the head of the wearer.

18. The communications headset as in claim 17 wherein a stop projects from said housing rearward of said holster for selectively engaging said earpiece when said earpiece is positioned in said holster to resist withdrawal of said earpiece from said holster.

* * * * *